US010944167B2

(12) United States Patent
Ahn et al.

(10) Patent No.: US 10,944,167 B2
(45) Date of Patent: Mar. 9, 2021

(54) ELECTRONIC DEVICE THAT REDUCES ANTENNA INTERFERENCE AND ENHANCES ANTENNA PERFORMANCE

(71) Applicant: SAMSUNG ELECTRONICS CO., LTD., Suwon-si (KR)

(72) Inventors: Jungho Ahn, Seoul (KR); Woosuk Kang, Suwon-si (KR); Sangbong Sung, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 192 days.

(21) Appl. No.: 16/056,960

(22) Filed: Aug. 7, 2018

(65) Prior Publication Data

US 2019/0051980 A1 Feb. 14, 2019

(30) Foreign Application Priority Data

Aug. 8, 2017 (KR) ..... 10-2017-0100228

(51) Int. Cl.

| | |
|---|---|
| ***H01Q 1/52*** | (2006.01) |
| ***H01Q 1/38*** | (2006.01) |
| ***H01Q 21/30*** | (2006.01) |
| ***H01Q 1/24*** | (2006.01) |
| ***H01Q 5/307*** | (2015.01) |
| ***H01Q 9/27*** | (2006.01) |
| *H01Q 1/22* | (2006.01) |

(52) U.S. Cl.

CPC ..... *H01Q 1/521* (2013.01); *H01Q 1/243* (2013.01); *H01Q 1/38* (2013.01); *H01Q 5/307* (2015.01); *H01Q 9/27* (2013.01); *H01Q 21/30* (2013.01); *H01Q 1/2291* (2013.01)

(58) Field of Classification Search

CPC ..... H01Q 1/521; H01Q 5/307; H01Q 9/27; H01Q 21/30; H01Q 1/243; H01Q 1/38; H01Q 1/2291

See application file for complete search history.

(56) References Cited

U.S. PATENT DOCUMENTS

| | | |
|---|---|---|
| 2002/0122009 A1 | 9/2002 | Winebrand et al. |
| 2004/0051675 A1 | 3/2004 | Inoue |

(Continued)

FOREIGN PATENT DOCUMENTS

| | | |
|---|---|---|
| JP | 2013-219757 | 10/2013 |
| KR | 10-2015-0066279 | 6/2015 |
| KR | 10-2016-0015715 | 2/2016 |

*Primary Examiner* — Dimary S Lopez Cruz
*Assistant Examiner* — Michael M Bouizza
(74) *Attorney, Agent, or Firm* — Nixon & Vanderhye P.C.

(57) ABSTRACT

The present disclosure relates to an electronic device made in a small size for IoT. An electronic device according to various embodiments includes: a housing; and a substrate disposed in the housing, in which the substrate may include: an upper feed point disposed on a top of the substrate and connecting a communication circuit and an antenna for WiFi to each other; a lower feed point disposed on a bottom of the substrate and connecting the communication circuit and an antenna for cellular communication to each other; and a conductive pad disposed on the top of the substrate to overlap the lower feed point and connected with an antenna for a Global Navigation Satellite System (GNSS) and/or a Global Positioning System (GPS).

12 Claims, 19 Drawing Sheets

(56) References Cited

U.S. PATENT DOCUMENTS

| | | | | |
|---|---|---|---|---|
| 2004/0056803 | A1* | 3/2004 | Soutiaguine | H01Q 9/0414 343/700 MS |
| 2014/0253393 | A1* | 9/2014 | Nissinen | H01Q 1/36 343/702 |
| 2016/0254587 | A1* | 9/2016 | Jung | H04B 5/0037 343/702 |
| 2017/0047647 | A1* | 2/2017 | Jung | H01Q 1/273 |
| 2017/0170677 | A1* | 6/2017 | Park | G06F 1/26 |
| 2018/0069300 | A1* | 3/2018 | Choi | G04R 60/06 |
| 2018/0129170 | A1* | 5/2018 | Yun | G06F 1/163 |

* cited by examiner

ELECTRONIC DEVICE THAT REDUCES ANTENNA INTERFERENCE AND ENHANCES ANTENNA PERFORMANCE

CROSS-REFERENCE TO RELATED APPLICATION

This application is based on and claims priority under 35 U.S.C. § 119 to Korean Patent Application No. 10-2017-0100228, filed on Aug. 8, 2017, in the Korean Intellectual Property Office, the disclosure of which is incorporated by reference herein in its entirety.

BACKGROUND

1) Field

The disclosure relates to a small-sized electronic device for Internet of Things (IoT).

2) Description of Related Art

Recently, technologies and services about IoT have been actively studied.

As a service using IoT, there is a locating service using an IoT device. Devices that support the locating service are made in small sizes in comparison to smartphones and can provide the function of transmitting/receiving information of a location tag, current location information, and current time information.

IoT devices may include a plurality of antennas supporting cellular communication, near field communication, or a GPS to transmit/receive current location information.

However, since IoT devices are manufactured in small sizes, the antenna performance may be deteriorated due to interference among a plurality of antennas.

SUMMARY

Embodiments of the disclosure can provide an electronic device including a plurality of antennas for IoT, the electronic device being able to improve antenna performance by reducing interference among a plurality of antennas.

In accordance with an aspect of the disclosure, an electronic device is provided, the electronic device including: a housing including a first housing facing a first direction, a second housing facing a second direction opposite the first direction, and a side member surrounding at least a portion of the space between the first housing and the second housing; a substrate disposed in the housing and having a first surface facing the first direction and a second surface facing the second direction opposite the first direction; a first bracket disposed between the substrate and the first housing and including a first antenna and a second antenna; and a second bracket disposed between the substrate and the second housing and including a third antenna, wherein the substrate includes a communication circuit and a processor electrically connected with the communication circuit, the first surface including a first feed point connected to the communication circuit and a first connecting member connecting the first feed point and the first antenna to each other, the second surface including a second feed point connected to the communication circuit and a second connecting member connecting the second feed point and the third antenna to each other, and the first surface further includes a conductive pad disposed to overlap the second feed point and a third connecting member connecting the conductive pad and the second antenna to each other.

In accordance with another aspect of the disclosure, an electronic device is provided, the electronic device including: a housing; and a substrate disposed in the housing, wherein the substrate includes: an upper feed point disposed on the top surface thereof and connecting a communication circuit and an antenna for WiFi to each other; a lower feed point disposed on a bottom surface thereof and connecting the communication circuit and an antenna for cellular communication to each other; and a conductive pad disposed on the top surface to overlap the lower feed point and connected to an antenna for a Global Navigation Satellite System (GNSS) and/or a Global Positioning System (GPS).

According to various embodiments, it is possible to improve antenna performance by reducing interference among a plurality of antennas in an electronic device including a plurality of antennal for IoT.

BRIEF DESCRIPTION OF THE DRAWINGS

The above and other aspects, features, and advantages of certain embodiments of the present disclosure will be more apparent from the following detailed description, taken in conjunction with the accompanying drawings, in which.

DETAILED DESCRIPTION

Figure 1:
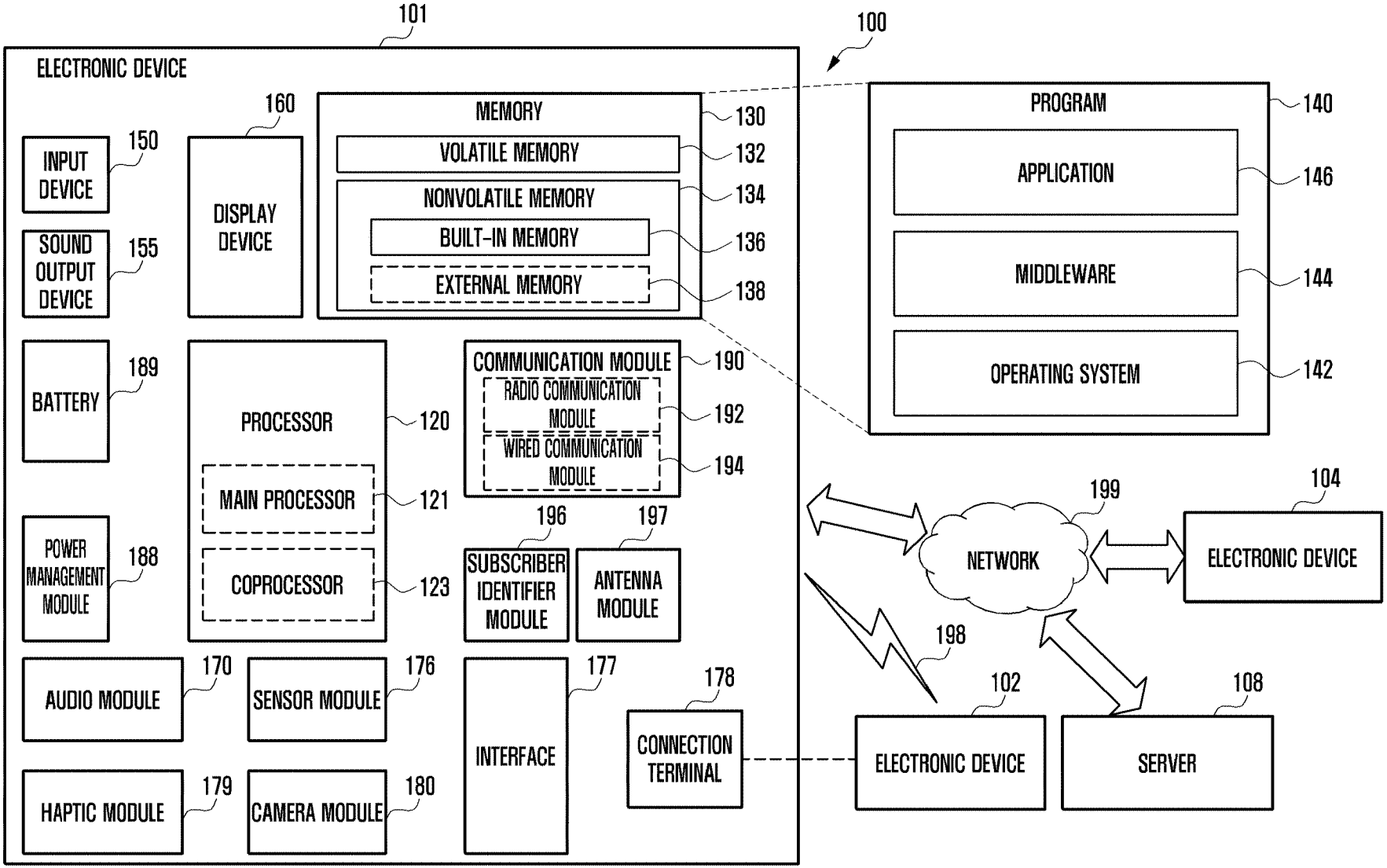
FIG. 1 is a block diagram illustrating an electronic device in a network environment according to various embodiments.

FIG. 1 is a block diagram illustrating an electronic device 101 in a network environment 100 according to various embodiments. Referring to FIG. 1, the electronic device 101 in the network environment 100 may communicate with an electronic device 102 via a first network 198 (e.g., a short-range wireless communication network), and/or an electronic device 104 and/or a server 108 via a second network 199 (e.g., a long-range wireless communication network). According to an embodiment, the electronic device 101 may communicate with the electronic device 104 via the server 108. According to an embodiment, the electronic device 101 may include a processor (e.g., including processing circuitry) 120, memory 130, an input device (e.g., including input circuitry) 150, a sound output device (e.g., including sound output circuitry) 155, a display device (e.g., including a display) 160, an audio module (e.g., including audio circuitry) 170, a sensor module 176, an interface (e.g., including interface circuitry) 177, a haptic module (e.g., including haptic circuitry) 179, a camera module 180, a power management module 188, a battery 189, a communication module (e.g., including communication circuitry) 190, a subscriber identification module (SIM) 196, and/or an antenna module 197.

In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may include various processing circuitry and execute, for example, software (e.g., a program 140) to control at least one other component (e.g., a hardware or software component) of the electronic device 101 coupled with the processor 120, and may perform various data processing or computation. According to an example embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may include various processing circuitry and control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, and/or an application 146.

The input device 150 may receive a command or data to be used by other component (e.g., the processor 120) of the electronic device 101, from the outside (e.g., a user) of the electronic device 101. The input device 150 may include, for example, a microphone, a mouse, or a keyboard.

The sound output device 155 may include various sound output circuitry and output sound signals to the outside of the electronic device 101. The sound output device 155 may include various sound output circuitry, such as, for example, and without limitation, a speaker and/or a receiver, or the like. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, and without limitation, a display, a hologram device, and/or a projector, or the like, and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may include various audio circuitry and convert a sound into an electrical signal and vice versa. According to an embodiment, the audio module 170 may obtain the sound via the input device 150, and/or output the sound via the sound output device 155 or a headphone of an external electronic device (e.g., an electronic device 102) directly (e.g., by wire) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, and without limitation, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, and/or an illuminance sensor, or the like.

The interface 177 may include various interface circuitry and support one or more specified protocols to be used for the electronic device 101 to be coupled with the external electronic device (e.g., the electronic device 102) directly (e.g., wired) or wirelessly. According to an embodiment, the interface 177 may include various interface circuitry, such as, for example, and without limitation, a high definition multimedia interface (HDMI), a universal serial bus (USB) interface, a secure digital (SD) card interface, and/or an audio interface, or the like.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector), The haptic module 179 may include various haptic circuitry and convert an electrical signal into a mechanical stimulus (e.g., a vibration or a movement) or electrical stimulus which may be recognized by a user via his tactile sensation or kinesthetic sensation. According to an embodiment, the haptic module 179 may include various haptic circuitry, such as, for example, and without limitation, a motor, a piezoelectric element, and/or an electric stimulator, or the like.

The camera module 180 may capture a still image or moving images. According to an embodiment, the camera module 180 may include one or more lenses, image sensors, image signal processors, or flashes.

The power management module 188 may manage power supplied to the electronic device 101. According to an example embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may include various communication circuitry and support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™ wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include one or more antennas, and, therefrom, at least one antenna appropriate for a communication scheme used in the communication network, such as the first network 198 or the second network 199, may be selected, for example, by the communication module 190 (e.g., the wireless communication module 192). The signal or the power may then be transmitted and/or received between the communication module 190 and the external electronic device via the selected at least one antenna.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
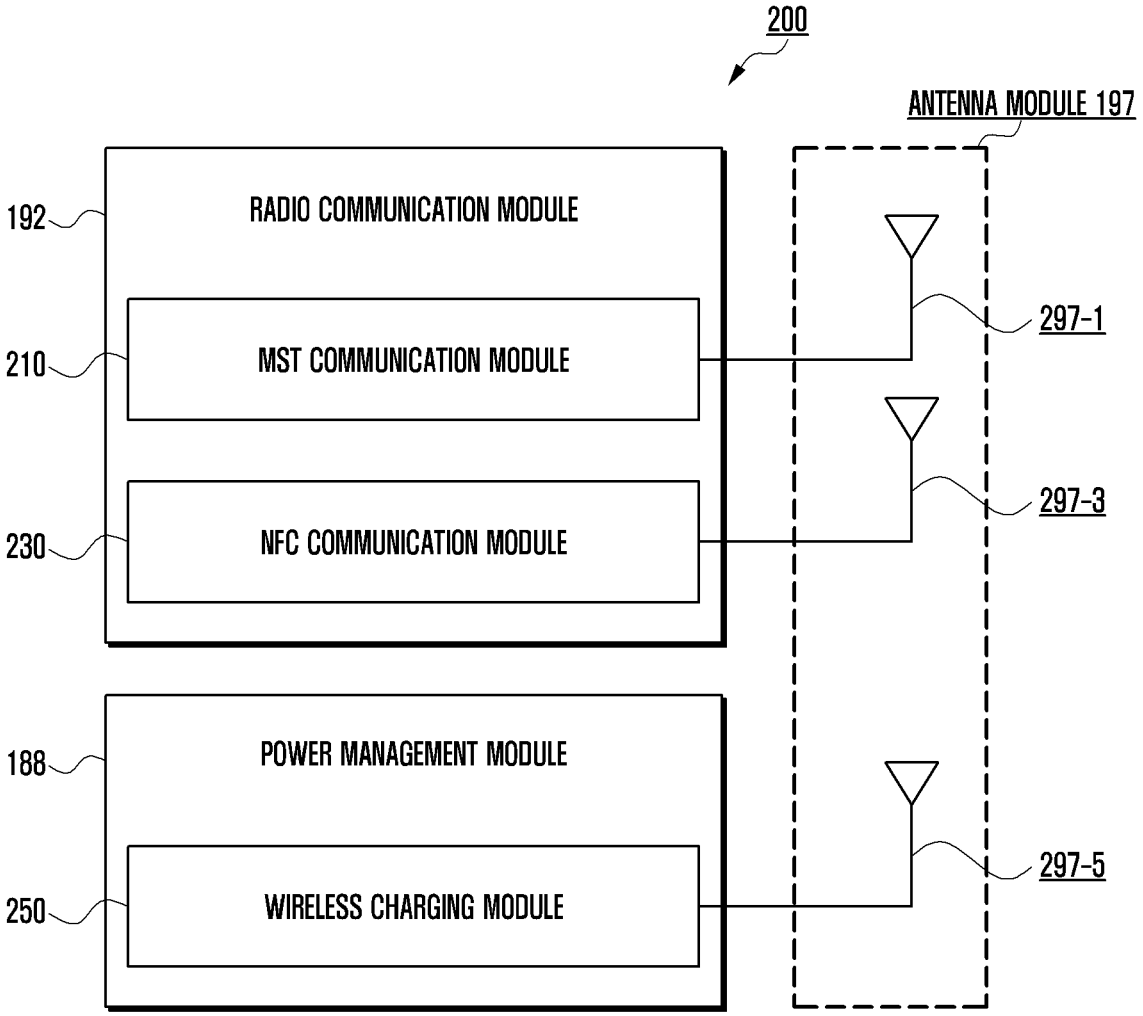
FIG. 2 is a block diagram illustrating the wireless communication module, the power management module, and the antenna module of the electronic device according to various embodiments.

FIG. 2 is a block diagram 200 illustrating the wireless communication module 192, the power management module 188, and the antenna module 197 of the electronic device 101 according to various embodiments.

Referring to FIG. 2, the wireless communication module 192 may include a magnetic secure transmission (MST) communication module (e.g., including MST communication circuitry) 210 and/or a near-field communication (NFC) module (e.g., including NFC communication circuitry) 230, and the power management module 188 may include a wireless charging module 250. In such a case, the antenna module 197 may include a plurality of antennas that include, for example, a MST antenna 297-1 connected with the MST communication module 210, a NFC antenna 297-3 connected with the NFC communication module 230, and a wireless charging antenna 297-5 connected with the wireless charging module 250. For ease of description, the same components as those described with reference to FIG. 1 are briefly described or not repeated in the following description.

The MST communication module 210 may include various MST communication circuitry and receive a signal containing control information or payment information such as card information from the processor 120, generate a magnetic signal corresponding to the received signal, and then transfer the generated magnetic signal to the external electronic device 102 (e.g., a point-of-sale (POS) device) via the MST antenna 297-1. To generate the magnetic signal, according to an embodiment, the MST communication module 210 may include a switching module (not shown) that includes one or more switches connected with the MST antenna 297-1, and control the switching module to change the direction of voltage or current supplied to the MST antenna 297-1 according to the received signal. The change of the direction of the voltage or current allows the direction of the magnetic signal (e.g., a magnetic field) emitted from the MST antenna 297-1 to change accordingly. If detected at the external electronic device 102, the magnetic signal with its direction changing may cause an effect (e.g., a waveform) similar to that of a magnetic field that is generated when a magnetic card corresponding to the card information associated with the received signal is swiped through a card reader of the electronic device 102. According to an embodiment, for example, payment-related information and a control signal that are received by the electronic device 102 in the form of the magnetic signal may be further transmitted to an external server 108 (e.g., a payment server) via the network 199.

The NFC communication module 230 may obtain a signal containing control information or payment information such as card information from the processor 120 and transmit the obtained signal to the external electronic device 102 via the NFC antenna 297-3. According to an embodiment, the NFC communication module 230 may receive such a signal transmitted from the external electronic device 102 via the NFC antenna 297-3.

The wireless charging module 250 may wirelessly transmit power to the external electronic device 102 (e.g., a cellular phone or wearable device) via the wireless charging antenna 297-5, or wirelessly receive power from the external electronic device 102 (e.g., a wireless charging device). The wireless charging module 250 may support one or more of various wireless charging schemes including, for example, a magnetic resonance scheme or a magnetic induction scheme.

According to an embodiment, some of the MST antenna 297-1, the NFC antenna 297-3, and/or the wireless charging antenna 297-5 may share at least part of their radiators. For example, the radiator of the MST antenna 297-1 may be used as the radiator of the NFC antenna 297-3 or the wireless charging antenna 297-5, or vice versa. In such a case, the antenna module 197 may include a switching circuit (not shown) adapted to selectively connect (e.g., close) or disconnect (e.g. open) at least part of the antennas 297-1, 297-3, or 297-5, for example, under the control of the wireless communication module 192 (e.g., the MST communication module 210 or the NFC communication module 230) or the power management module (e.g., the wireless charging module 250). For example, when the electronic device 101 uses a wireless charging function, the NFC communication module 230 or the wireless charging module 250 may control the switching circuit to temporarily disconnect at least one portion of the radiators shared by the NFC antenna 297-3 and the wireless charging antenna 297-5 from the NFC antenna 297-3 and to connect the at least one portion of the radiators with the wireless charging antenna 297-5.

According to an embodiment, at least one function of the MST communication module 210, the NFC communication module 230, and/or the wireless charging module 250 may be controlled by an external processor (e.g., the processor 120). According to an embodiment, at least one specified function (e.g., a payment function) of the MST communication module 210 or the NFC communication module 230 may be performed in a trusted execution environment (TEE). According to an embodiment, the TEE may form an execution environment in which, for example, at least some designated area of the memory 130 is allocated to be used for performing a function (e.g., a financial transaction or personal information-related function) that requires a relatively high level of security. In such a case, access to the at least some designated area of the memory 130 may be restrictively permitted, for example, according to an entity accessing thereto or an application being executed in the TEE.

Figure 6:
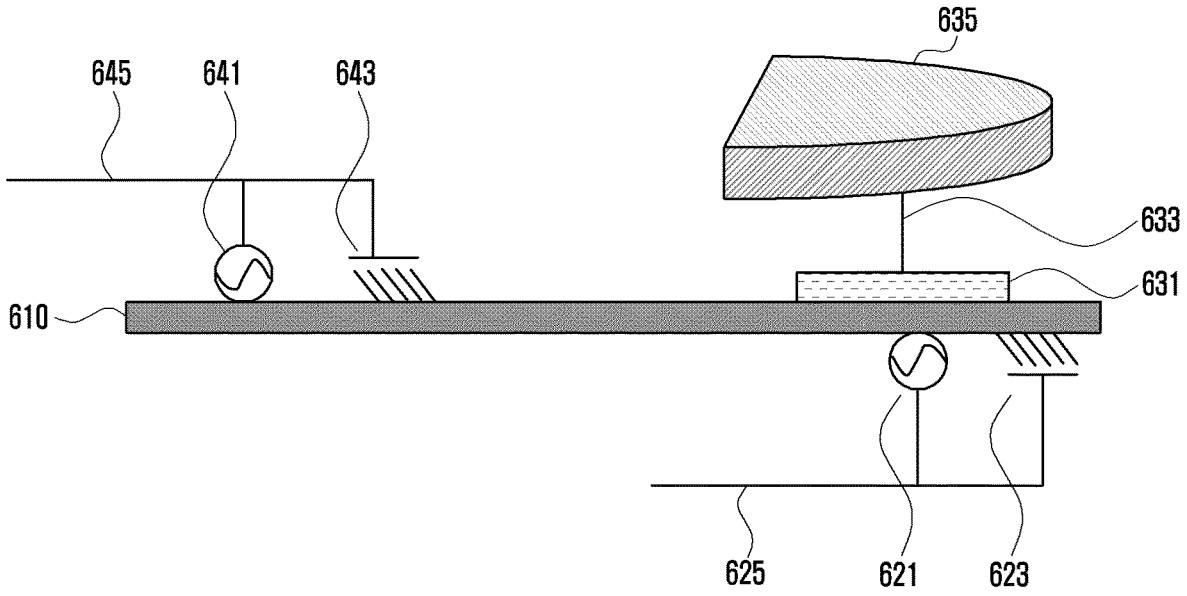
FIG. 6 is a cross-sectional view illustrating a structure connecting antennas in the electronic device according to an embodiment.

With reference to FIG. 6, an electronic device according to various embodiments may include: a housing including a first housing facing a first direction, a second housing facing a second direction opposite the first direction, and a side member comprising a surface surrounding at least a portion of the space between the first housing and the second housing; a substrate (e.g., 610 of FIG. 6) disposed in the housing and having a first surface facing the first direction and a second surface facing the second direction opposite the first direction; a first bracket disposed between the substrate 610 and the first housing and including a first antenna (e.g., 645 of FIG. 6) and a second antenna (e.g., 635 of FIG. 6); and a second bracket disposed between the substrate 610 and the second housing and including a third antenna (e.g., 625 of FIG. 6). The substrate 610 includes a communication circuit (e.g., 190) and a processor electrically connected with the communication circuit 190. The first surface includes a first feed point (e.g., 641 of FIG. 6) connected with the communication circuit 190 and a first connecting member connecting the first feed point 641 and the first antenna 645 to each other. The second surface has a second feed point (e.g., 621 of FIG. 6) connected with the communication circuit 190 and a second connecting member connecting the second feed point 621 and the third antenna 625 to each other. The first surface further includes a conductive pad (e.g., 631 of FIG. 6) disposed to overlap the second feed point 621 and a third connecting member connecting the conductive pad 631 and the second antenna 635 to each other. For example, and without limitation, the first antenna 645 may be configured to transmit/receive frequency signals for WiFi, the second antenna 635 may be configured to receive frequency signals for a Global Navigation Satellite System (GNSS) or a Global Positioning System (GPS), and the third antenna 625 may be configured to transmit/receive frequency signals for cellular communication. The first feed point 641 and the second feed point 621 may be positioned on opposite sides when seen from over the first surface or the second surface. The first antenna 645 may be disposed on a side of the first bracket and the second antenna 635 may be disposed on the top, which faces the first direction, of the first bracket. The second antenna 635 may be spaced from the first antenna 645, on the top of the first bracket. The second antenna 635 may have a semicircular shape. The second antenna 635 may have a spiral shape. The second antenna 635 may be spirally wound from an outer portion, which is connected with the third connecting member, of the top of the first bracket such that the end reaches the center of the top of the first bracket. The second antenna 635 has a first part spirally wound from a side, which is connected with the third connecting member, of the top of the first bracket and extending to the center of the top of the first bracket and a second part extending from the first part to another outer portion of the top of the first bracket. The third antenna 625 may be disposed on a side of the second bracket and may be positioned opposite the first antenna 645 when seen from over the first surface or the second surface. The cellular communication may be at least one of LTE, LTE-A (LTE Advance), Code Division Multiple Access (CDMA), Wideband CDMA (WCDMA), Universal Mobile Telecommunications System (UMTS), Wireless Broadband (WiBro), Global System for Mobile Communications (GSM), Cat-1, Cat-M1, and NB-IoT. The communication circuit 190 may be electrically connected with the second antenna 635 by capacitance (capacitive coupling) between the second feed point 621 and the conductive pad 631.

With reference to FIG. 6, an electronic device according to various embodiments may include a housing and a substrate (e.g., 610) disposed in the housing. The substrate 610 may include: an upper feed point (e.g., 641) disposed on the top surface thereof and connecting a communication circuit (e.g., 190) and an antenna (e.g., 645) for WiFi to each other; a lower feed point (e.g., 621) disposed on a bottom surface thereof and connecting the communication circuit 190 and an antenna (e.g., 625) for cellular communication to each other; and a conductive pad (e.g., 631) disposed on the top surface to overlap the lower feed point and connected with an antenna (e.g., 635) for a GNSS or a GPS. The antenna 645 for WiFi and the antenna 635 for a GNSS or a GPS may be disposed on an upper bracket disposed to face the top of the substrate 610 in the housing and the antenna 625 for cellular communication may be disposed on a lower bracket disposed to face the bottom of the substrate 610 in the housing. The antenna 645 for WiFi may be disposed on a side of the upper bracket and the antenna 635 for a GNSS or a GPS may be disposed at at least a portion of the top of the upper bracket.

Figure 3A:
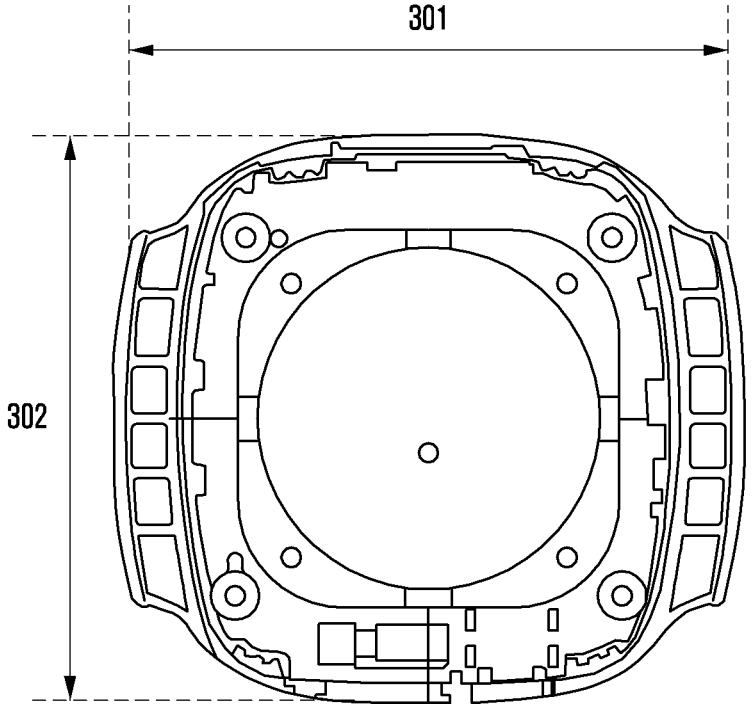
FIGS. 3A and 3B are diagrams illustrating the external appearance of an electronic device according to various embodiments.
Figure 3B:
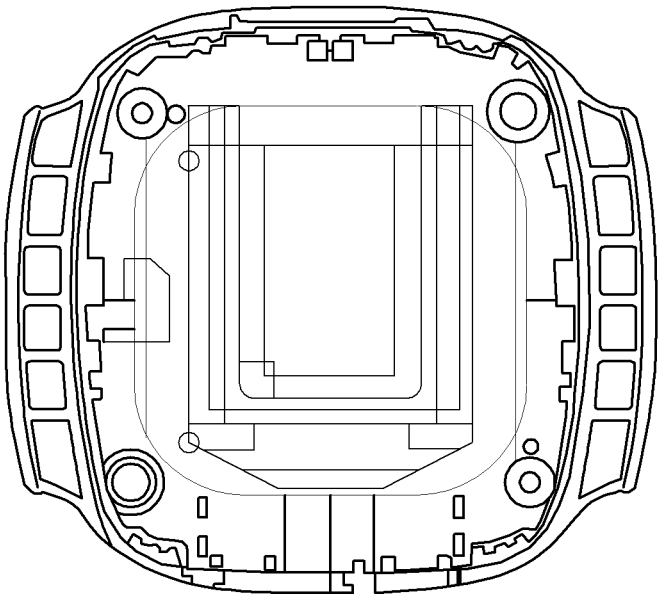

FIGS. 3A and 3B are diagrams illustrating the external appearance of an electronic device 101 according to an embodiment. According to an embodiment, FIG. 3A may illustrate the front side of the electronic device 101 and FIG. 3B may illustrate the rear side of the electronic device 101.

Referring to FIGS. 3A and 3B, an electronic device (e.g., 101) according to an embodiment may be an IoT device for transmitting/receiving current location information. For example, and without limitation, the electronic device 101 according to an embodiment may be a device designed to support IoT and having a width 301 of about 40 mm and a length 302 of about 60 mm to be easily carried.

Figure 4:
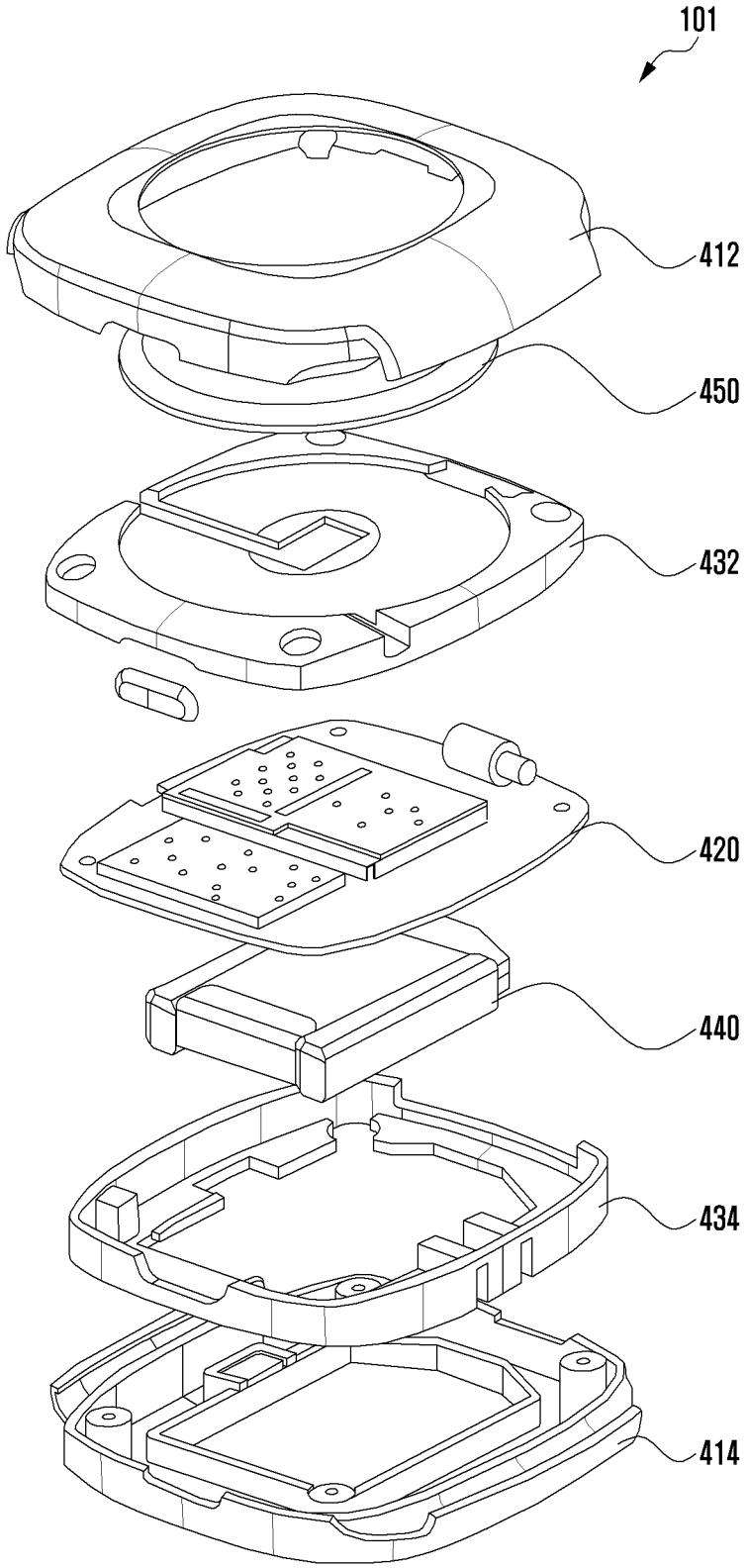
FIG. 4 is an exploded perspective view illustrating the electronic device according to various embodiments.

FIG. 4 is an exploded perspective view illustrating the electronic device 101 according to various embodiments. According to an embodiment, FIG. 4 may be an exploded perspective view of the electronic device illustrated in FIG. 3.

Referring to FIG. 4, an electronic device (e.g., 101) according to various embodiments may include housings 412 and 414, a substrate 420, brackets 432 and 434, a battery 440, and an operation key 450.

According to an embodiment, the housings 412 and 414 may include a first housing 412 facing a first direction (e.g., upward in FIG. 4), a second housing 414 facing a second direction (e.g., downward in FIG. 4) opposite the first direction, and a side member including a surface surrounding at least a portion of the space between the first and second housings 412 and 414. For example, the first housing 412 may be an upper housing and the second housing 414 may be a lower housing. According to an embodiment, components (e.g., the substrate 420, brackets 432 and 434, battery 440, and operation key 450) of the electronic device 101 may be disposed in the housings 412 and 414.

According to an embodiment, the substrate 420 may be disposed within the housings 412 and 414. For example, the substrate 420 may be disposed between the first housing 412 and the second housing 414. According to an embodiment, the substrate 420 may, for example, and without limitation, be implemented using at least one of a Printed Circuit Board (PCB) and/or a Flexible Printed Circuit Board (FPCB), or the like. According to an embodiment, the substrate 420 may have a first surface facing the first direction and a second surface facing the second direction opposite the first direction. For example, and without limitation, the first surface may be the top of the substrate 420 and the second surface may be the bottom of the substrate 420, or vice versa.

According to an embodiment, the substrate 420 may include a communication module 190 and a processor 120 electrically connected with the communication module 190.

According to an embodiment, the communication module 190 may include a first communication module transmitting/receiving frequency signals for WiFi through a first antenna (e.g., 645, refer to FIG. 6), a second communication module receiving frequency signals for a GNSS or a GPS through a second antenna (e.g., 635, refer to FIG. 6), or a third communication module transmitting/receiving frequency signals for cellular communication through a third antenna (e.g., 625, see FIG. 6). According to an embodiment, the first to third communication module may be integrated or at least some of the communication modules may be separately configured. According to an embodiment, the cellular communication may be at least one of LTE, LTE-A (LTE Advance), Code Division Multiple Access (CDMA), Wideband CDMA (WCDMA), Universal Mobile Telecommunications System (UMTS), Wireless Broadband (WiBro), Global System for Mobile Communications (GSM), Cat-1, Cat-M1, and NB-IoT. According to an embodiment, the first to third antennas may be disposed on a bracket. The positions and shapes of the first to third antennas 645, 635, and 625 will be described in detail below with reference to FIGS. 5 to 8.

According to an embodiment, the processor 120 may include various processing circuitry, such as, for example, and without limitation, one or more of a dedicated processor, a Central Processing Unit (CPU), an Application Processor (AP), and/or a Communication Processor (CP), or the like. The processor 120, for example, can perform calculation or data processing about control and/or communication of one or more other components of the electronic device 101. According to an embodiment, the processor 120 can control power to be fed to the communication module 190.

According to various embodiments, the communication module 190 may include various communication circuitry and may transmit/receive electrical signals to/from the first to third antennas 645, 635, and 625 through a feed point (e.g., 621, see FIG. 6) on the substrate 420. For example, the communication module 190 can feed a current to the first to third antennas 645, 635, and 625 and can receive currents from the first to third antennas 645, 635, and 625.

According to an embodiment, the brackets 432 and 434 may include a first bracket 432 disposed between the substrate 420 and the first housing 412 and a second bracket 434 disposed between the substrate 420 and the second housing 414. For example, the first bracket 432 may be an upper bracket and the second bracket 434 may be a lower bracket.

According to an embodiment, a bracket may include antennas. For example, the first bracket 432 may include the first antenna 645 and the second antenna 635 and the second bracket 434 may include the third antenna 625. According to an embodiment, the antennas 645, 635, and 625 of the brackets 432 and 424 can be electrically connected with feed points (e.g., 641 and 621) on the substrate 210 through a connecting member (e.g., 633, see FIG. 6).

According to an embodiment, the battery 440 may be disposed between the substrate 420 and the second bracket 434. According to an embodiment, the battery 440, for example, may include a chargeable battery and/or a solar battery.

According to an embodiment, the operation key 450 may be disposed between the first housing 412 and the first bracket 432. According to an embodiment, the operation key 450 may, for example, and without limitation, include a button configured to be operated by a user to operate the electronic device 101. For example, and without limitation, the operation key 450 may be a physical button, or the like, which can sense push input from a user, and can transmit push information to the processor 120 when sensing push input. According to an embodiment, the electronic device 101 may not include the operation key 450.

Figure 5:
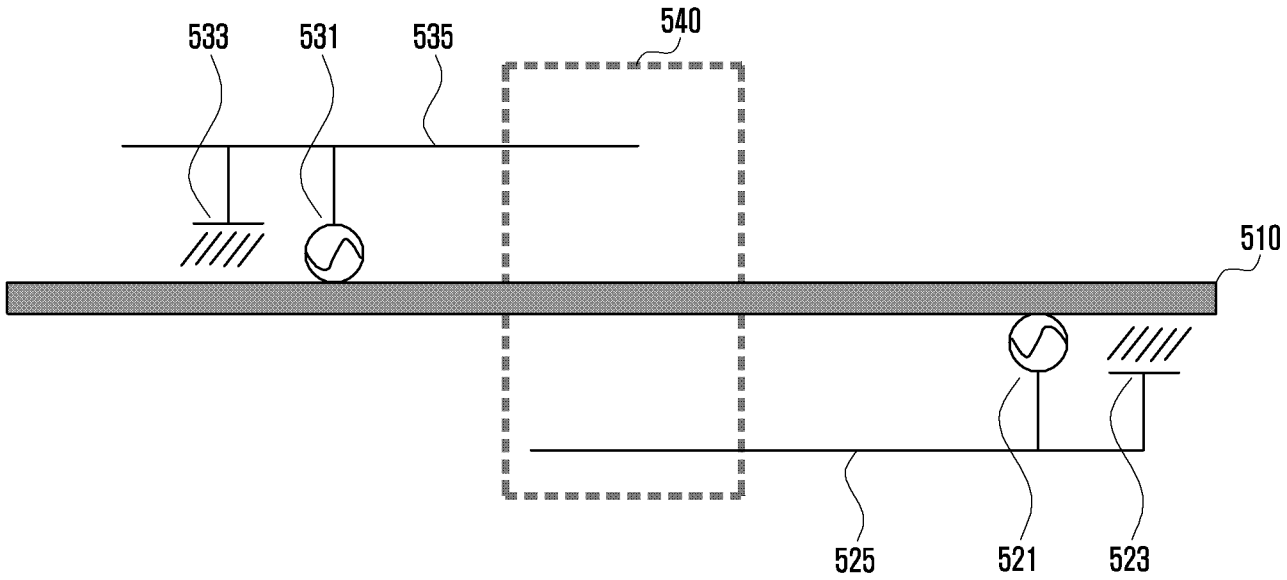
FIG. 5 is a cross-sectional view illustrating a structure connecting antennas in an electronic device according to a comparing example.

FIG. 5 is a cross-sectional view illustrating an example of a structure connecting antennas in an electronic device.

Referring to FIG. 5, in the electronic device according to an example, a first antenna 535 transmitting/receiving frequency signals for WiFi and receiving frequency signals for a GNSS and/or a GPS is disposed over/on top of a substrate 510 and a second antenna 525 transmitting/receiving frequency signals for cellular communication is disposed under the substrate 510. Further, in the electronic device according to an example, a feed point 531 and a first ground 533 that are connected with the first antenna 535 is disposed on the top of the substrate 510, and a second feed point 521 and a second ground 523 that are connected with the second antenna 525 are disposed on the bottom of the substrate 510.

In the electronic device according to the example illustrated in FIG. 5, as indicated by reference number 540, a portion of the first antenna 535 and a portion of the second antenna 525 overlap each other, so interference may be generated therebetween, whereby performance may be deteriorated.

FIG. 6 is a cross-sectional view illustrating a structure connecting antennas in the electronic device 101 according to an example embodiment.

Referring to FIG. 6, an electronic device (e.g., 101) according to an embodiment may address the problem of performance deterioration of the antennas of the electronic device according to a comparing example shown in FIG. 5.

According to an embodiment, a first antenna 645 transmitting/receiving frequency signals for WiFi and a second antenna 635 receiving frequency signals for a GNSS or a GPS may be disposed over/on top of a substrate 610 and a third antenna 625 transmitting/receiving frequency signals for cellular communication may be disposed under the substrate 610.

According to an embodiment, a first feed point 641 and a first ground 643 that are connected with the first antenna 645 may be disposed on the top (e.g., a first surface) of the substrate 610, and a second feed point 621 and a second ground 623 that are connected with the third antenna 625 may be disposed on the bottom (e.g., a second surface) of the substrate 610. According to various embodiments, a conductive pad 631 may be disposed on the top of the substrate 610 to overlap the second feed point 621 and may be electrically connected with the third antenna 625 through a connecting member (conductor) (e.g., 633). According to an embodiment, the first antenna to third antenna 645, 635, and 625 can be connected with the substrate 610 through first to third connecting members, respectively. For example, the first antenna 645 can be connected with a first feed point 641 through the first connecting member, the third antenna 625 can be connected with a second feed point 621 through the second connecting member, and the second antenna 635 can be connected with the conductive pad 631 through the third connecting member 633. According to an embodiment, the first to third connecting members may be elastic pins (e.g., C-clips).

According to an embodiment, the first feed point 641 and the second feed point 621 may be positioned on opposite sides when seen from over the first surface or the second surface.

Figure 7A:
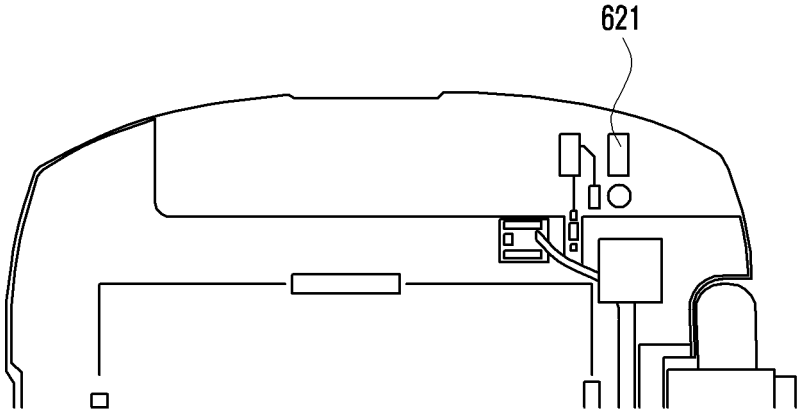
FIGS. 7A and 7B are diagrams illustrating a connection structure between a communication module and a second antenna according to an embodiment.
Figure 7B:
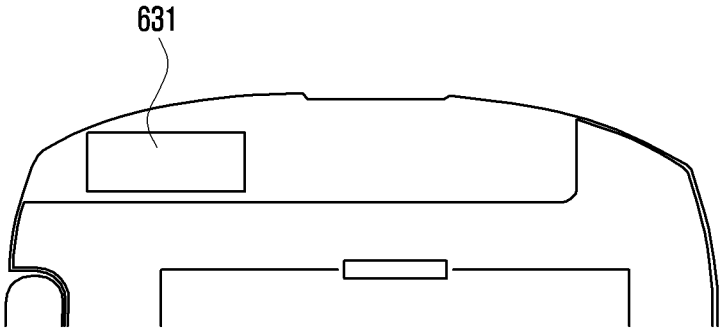

FIGS. 7A and 7B are diagrams illustrating a connection structure between the communication module 190 and the second antenna 635 according to an embodiment. According to an embodiment, FIG. 7A diagram illustrating a portion of the bottom of a substrate (e.g., 610) including a feed point (e.g., 621) of a third antenna (e.g., 625) transmitting/receiving frequency signals for cellular communication and FIG. 7B is a diagram illustrating a portion of the top of the substrate 610 corresponding to the feed point of the third antenna 625.

As illustrated in FIGS. 7A and 7B, according to an embodiment, a second feed point 621 transmitting/receiving frequency signals for cellular communication may be disposed on the bottom of the substrate 610 and a conductive pad 631 corresponding to the second feed point 621 may be disposed on the top of the substrate 610. For example, assuming that an axis vertically passing through the top or the bottom of the substrate 610 is a Z-axis, at least a portion of the second feed point 621 and at least a portion of the conductive pad 631 may be positioned on the same line in the Z-axial direction, and the substrate 610 may be disposed between at least a portion of the second feed point 621 and at least a portion of the conductive pad 631. According to an embodiment, the second feed point 621 transmitting/receiving frequency signals for cellular communication and the conductive pad 631 are physically spaced from each other with the substrate 610 therebetween, but the second feed point 621 and the conductive pad 631 can be electrically connected to each other by capacitance (capacitive coupling) therebetween. According to various embodiments, the conductive pad 631 is physically spaced from the second feed point 621 while overlapping the second feed point 621 and a communication module (e.g., 190) can control a third antenna 625, using a coupling effect by capacitance between the second feed point 621 and the conductive pad 631. For example, the third antenna 625 can generate a current by receiving a frequency signal for a GNSS or a GPS and the current generated by the third antenna 625 can be transmitted to the communication module 190 by the coupling effect between the second feed point 621 and the conductive pad 631.

According to an embodiment, at least one component may be further disposed between the second feed point 621 and the conductive pad 631. According to an embodiment, the additional component, for example, may include at least one nonconductive substance or an air gap.

Figure 8A:
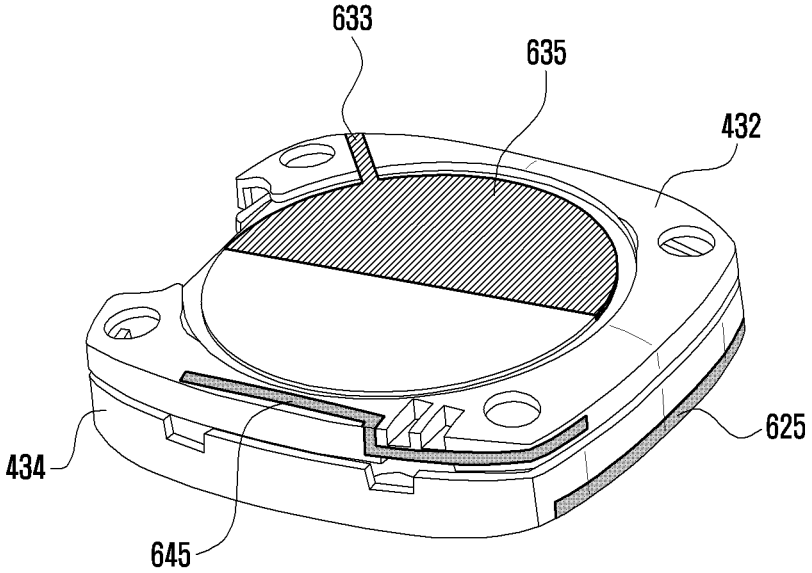
FIGS. 8A and 8B are diagrams illustrating an example connection structure for mounting first to third antennas according to an embodiment.
Figure 8B:
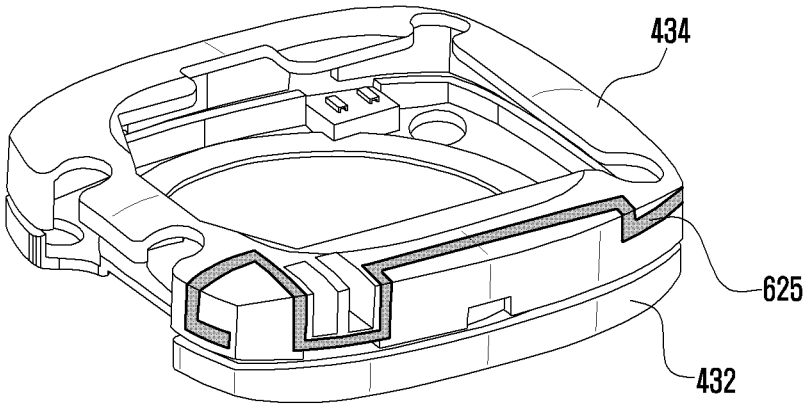

FIGS. 8A and 8B are diagrams illustrating an example connection structure for mounting first to third antennas 625 according to an embodiment. According to an embodiment, FIG. 8A may illustrate a top perspective view of an electronic device (e.g., 101) according to an embodiment and FIG. 8B may illustrate a bottom perspective view of the electronic device (e.g., 101) according to an embodiment.

Referring FIGS. 8A and 8B, in the electronic device 101 according to an embodiment, the first antenna 645 may be disposed on a side of a first bracket (e.g., 432), the second antenna 635 may be disposed on the top of the first bracket 432, and the third antenna 625 may be disposed on a side of a second bracket (e.g., 434).

According to an embodiment, the first antenna 645 and the third antenna 625 may be configured like an antenna having a length of λ/4 (e.g., an Inverted-F Antenna (IFA)) and the second antenna 635 may be configured in a plane type. According to an embodiment, the first antenna 645 and the third antenna 625 may be formed along sides of the first bracket 432 or the second bracket 434 and may be positioned such that the overlapping portion is minimized and/or reduced to reduce interference therebetween. For example, as illustrated in FIG. 8A, a portion of the first antenna 645 and a portion of the third antenna 625 may overlap each other only in a predetermined area on a side of the sides of the brackets 432 and 434 and the other portions may not overlap each other. According to an embodiment, the first antenna 645 and the third antenna 625 may not overlap each other throughout all sides of the brackets 432 and 434 by changing the design.

According to an embodiment, the second antenna 635 may be configured in a plane type covering the top of the first bracket 432. According to an embodiment, the second antenna 635 may have a semicircular shape. For example, the second antenna 635 may have a semicircular shape connected with the third connecting member (e.g., a conductor) 633 and may be spaced from the first antenna 645, on the top of the first bracket 432. According to various embodiments, the shape of the second antenna 635 can be changed in various shapes such as an ellipse or a polygon other than a semicircle. According to an embodiment, the second antenna 635, similar to the first antenna 645, may be formed on a side of the first bracket 432 and may be configured like an antenna having a length of λ/4 (e.g., an Inverted-F Antenna (IFA)).

FIG. 8B illustrates another example configuration of the third antenna 625 disposed on the bracket 434.

Figure 9:
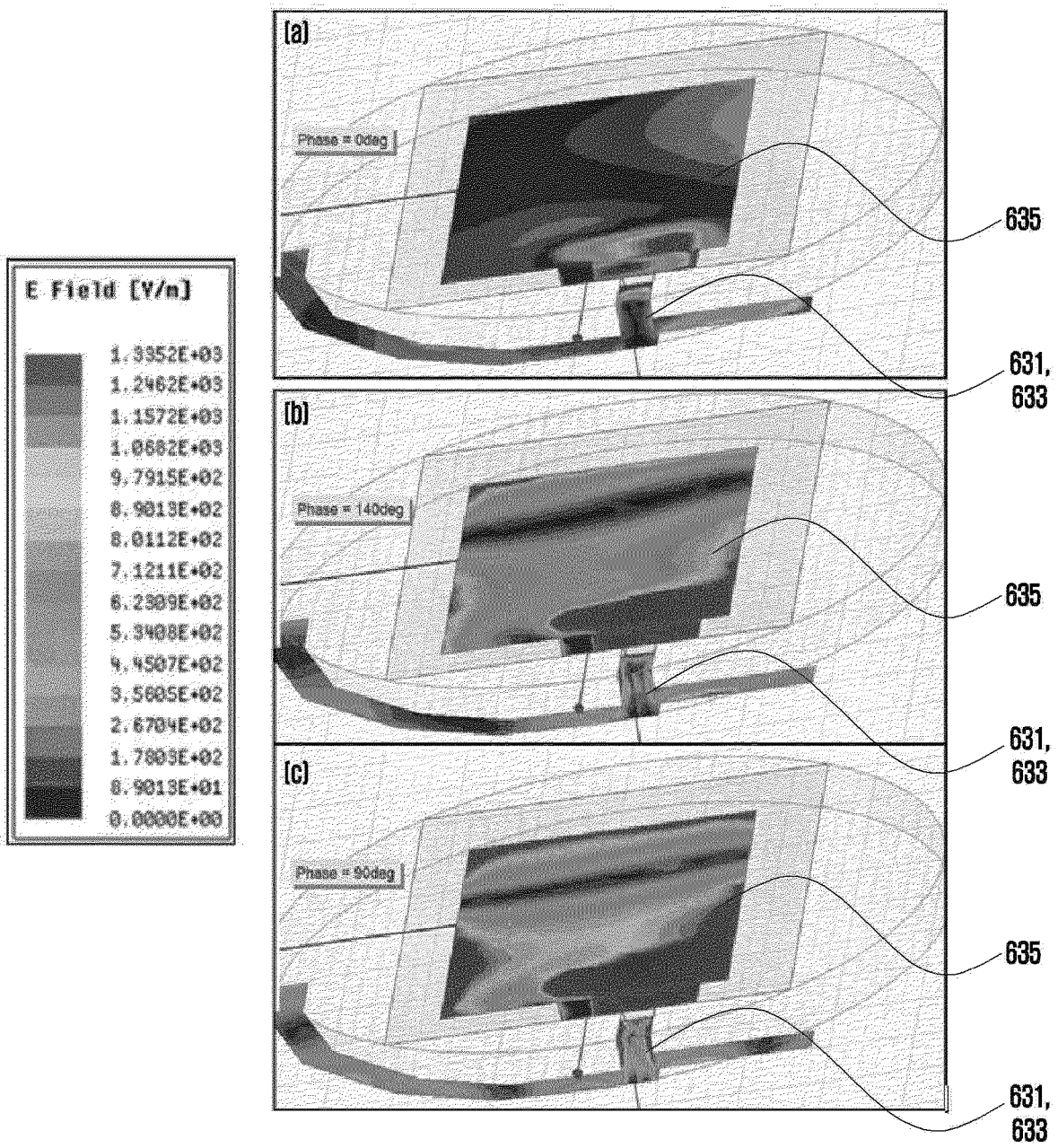
FIG. 9 is a diagram illustrating a result of testing antenna performance of the electronic device according to an embodiment.

FIG. 9 is a diagram illustrating a result of testing antenna performance of the electronic device 101 according to an embodiment. According to an embodiment, the test result illustrated in FIG. 9 may be a result of testing whether it is possible to control the second antenna 635 for a GPS even without directly connecting the second antenna 635 to a feed point on the substrate 610. For example, the test shown in FIG. 9 may be a result of measuring a radiation shape of the second antenna 635, as time passes, when a current is supplied to the second feed point 621 physically spaced from the second antenna 635.

Referring to FIG. 9, it can be seen that when a current was applied to the second feed point 621 transmitting/receiving frequency signals for cellular communication, the second antenna 635 was coupled to the capacitance between the second feed point 621 and the conductive pad 631, so a radiation pattern was formed by the second antenna 635.

Figure 10:
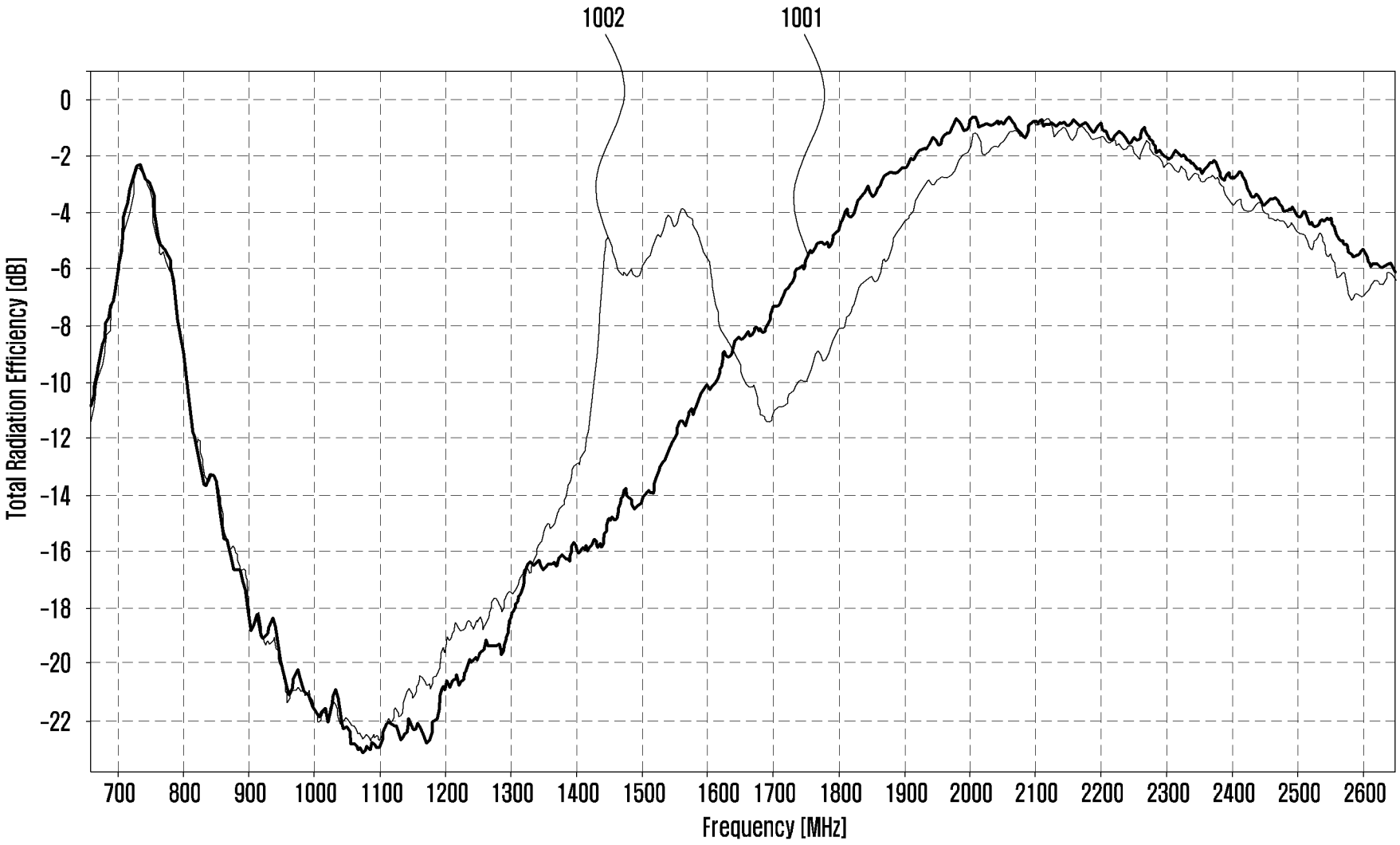
FIG. 10 is a graph illustrating a result of comparing an electronic device according to a comparing example and an electronic device according to an embodiment.

FIG. 10 is a graph illustrating a result of comparing an electronic device according to a comparing example and an electronic device (e.g., 101) according to an embodiment.

Referring to FIG. 10, it can be seen that an electronic device (e.g., 101) according to an embodiment shows higher radiation efficiency at 1.4 GHz to 1.7 GHz that is a frequency band for a GNSS or a GPS, as a result of comparing a graph 1001 showing the antenna performance in the electronic device according to a comparing example and a graph 1002 showing antenna performance in the electronic device 101 according to an embodiment. This may indirectly prove that interference among antennas was reduced in the electronic device 101 supporting a multi-band antenna according to an embodiment in comparison to the electronic device according to a comparing example.

Figure 11A:
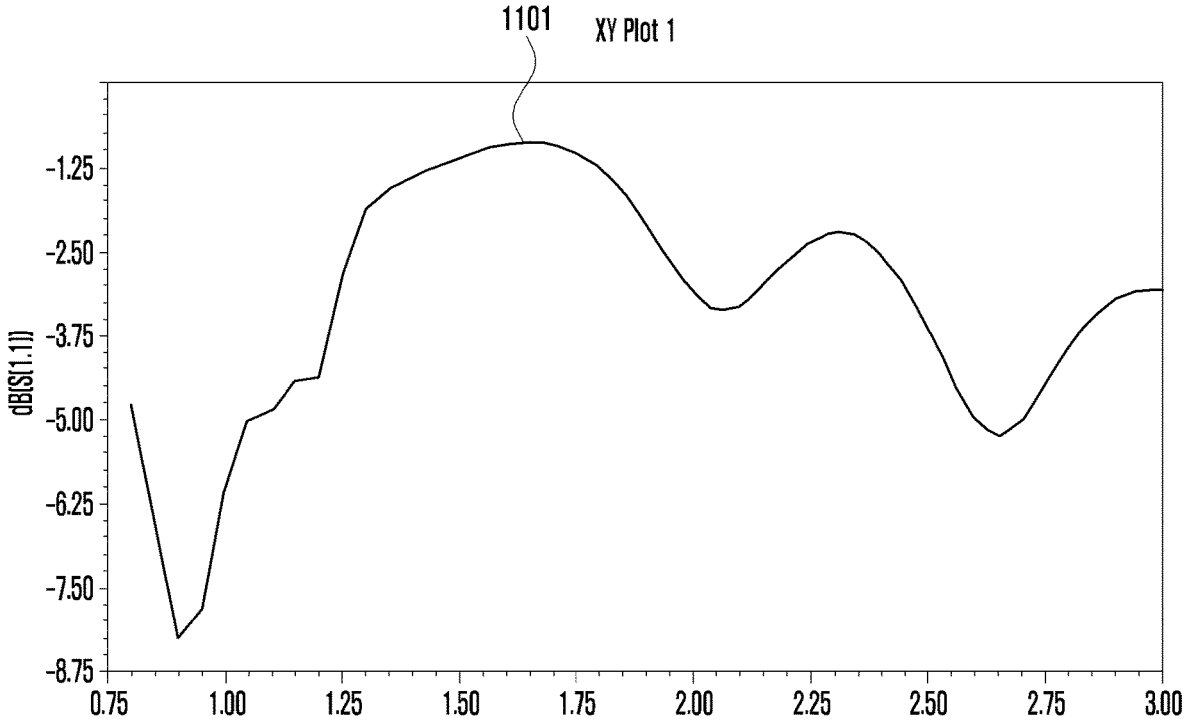
FIGS. 11A and 11B are graphs illustrating a result of comparing an electronic device according to a comparing example and an electronic device according to an embodiment.
Figure 11B:
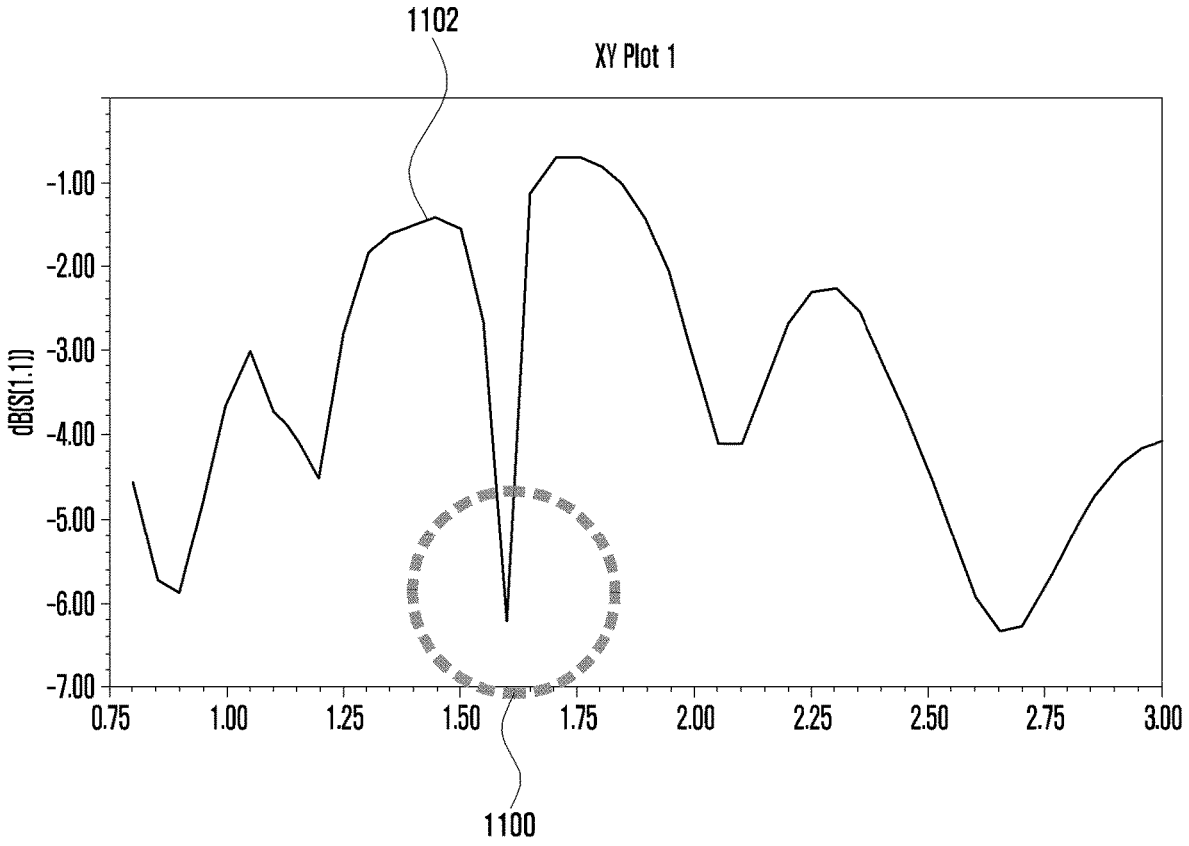

FIGS. 11A and 11B are graphs illustrating a result of comparing an electronic device according to a comparing example and an electronic device (e.g., 101) according to an embodiment. According to an embodiment, FIG. 11A may be a graph showing the Voltage Standing Wave Ratio (VSWR) of an electronic device according to a comparing example and FIG. 11B may be a graph showing the VSWR of an electronic device (e.g., 101) according to an embodiment.

Referring to FIGS. 11A and 11B, comparing the VSWR 1101 of an electronic device according to a comparing example and the VSWR 1102 of an electronic device 101 according to an embodiment with each other, it can be seen that a fall definitely occurred between 1.4 GHz and 1.7 GHz that is a frequency band for a GNSS or a GPS, as indicated by reference numeral 1100, in the electronic device 101 according to an embodiment. This may indirectly prove that interference among antennas was reduced in the electronic device 101 supporting a multi-band antenna according to an embodiment in comparison to the electronic device according to a comparing example.

Figure 12:
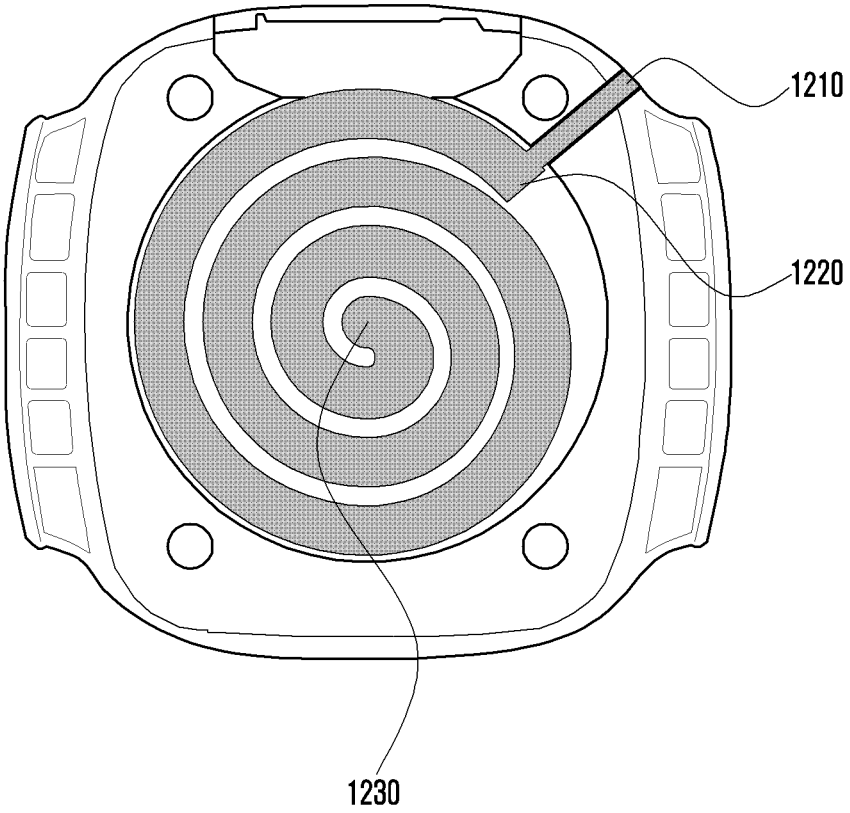
FIG. 12 is a diagram illustrating the shape of a second antenna of an electronic device according to another embodiment.
Figure 13:
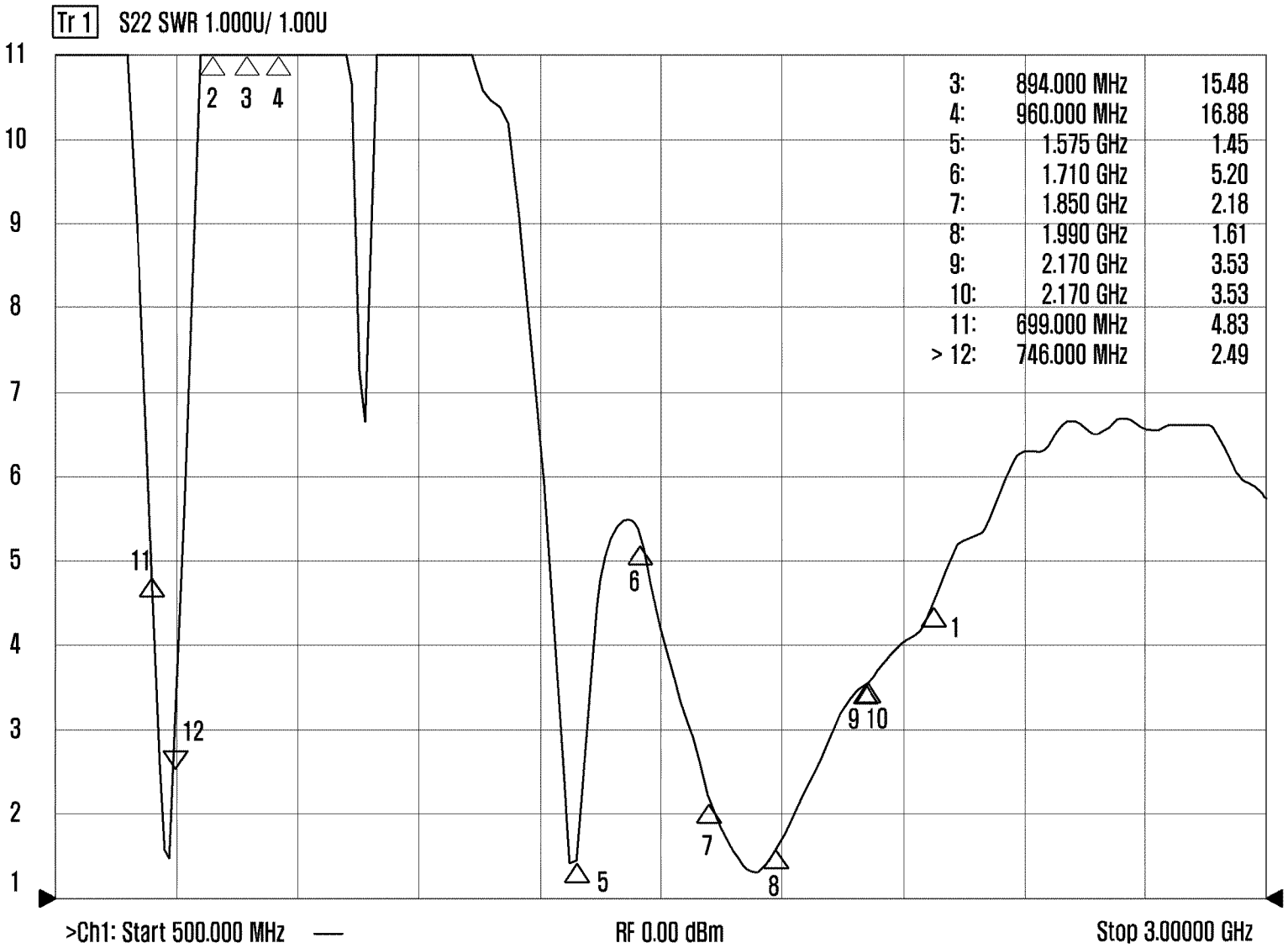
FIG. 13 is a graph illustrating the VSWR of an electronic device according to another embodiment.

FIG. 12 is a diagram illustrating a shape of the second antenna 635 of an electronic device (e.g., 101) according to another embodiment. FIG. 13 is a graph illustrating the VSWR of an electronic device 101 according to another embodiment.

Referring FIG. 12, in an electronic device (e.g., 101) according to another embodiment, a second antenna (e.g., 635) may be spirally configured in a plane covering the top of a first bracket 432. According to an embodiment, the second antenna 635 may be spirally wound from an outer portion 1220, which is connected with a third connecting member (conductor) 1210, of the top of the first bracket (e.g., 432) such that the end reaches the center 1230 of the top of the first bracket 432.

Since the second antenna 635 is spirally formed in the electronic device 101 according to another embodiment, the radiation pattern of the electronic device 101 can be induced to be concentrated in a specific direction (e.g., upward from the electronic device 101). For example, as the result of testing the performance of the electronic device 101 according to another embodiment, as shown in FIG. 13, it can be seen that a fall more definitely occurred at 1.575 GHz (e.g., point 5) or 1.850 GHz (e.g., point 7) that is a frequency band for a GNSS or a GPS.

Figure 14:
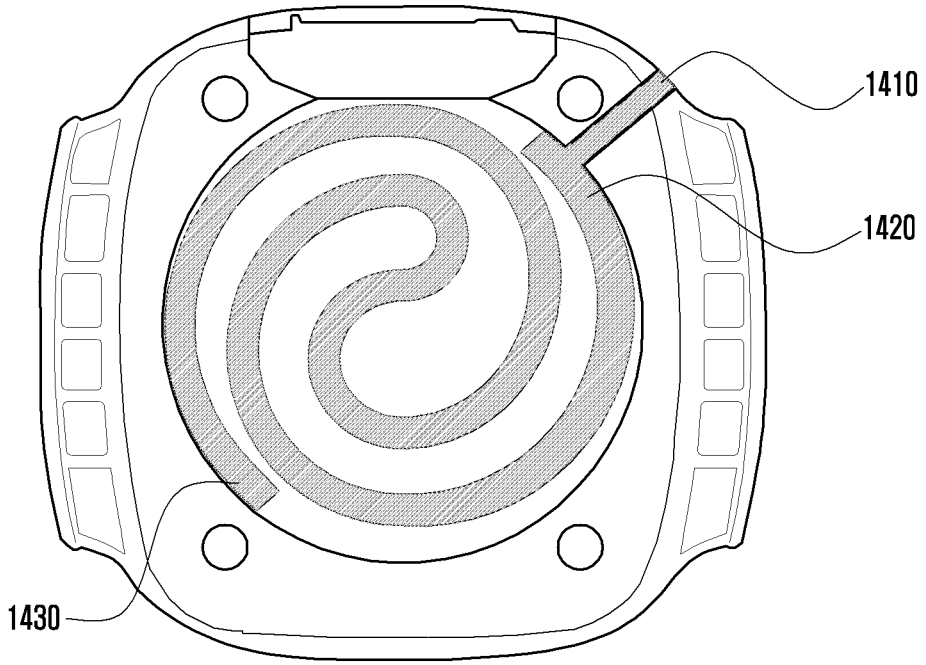
FIG. 14 is a diagram illustrating the shape of a second antenna of an electronic device according to another embodiment.

FIG. 14 is a diagram illustrating a shape of the second antenna 635 of an electronic device (e.g., 101) according to another embodiment.

Referring FIG. 14, in an electronic device (e.g., 101) according to another embodiment, a second antenna (e.g., 635) may be spirally configured in a plane covering the top of a first bracket (e.g., 432). According to an embodiment, the second antenna 635 may include a first part 1420 spirally wound from a side, which is connected with a third connecting member (conductor) 1410, of the top of the first bracket 432 and extending to the center of the top of the first bracket 432 and a second part 1430 connected with the first part 1420 and extending to another outer portion of the top of the first bracket 432 from the center of the top of the first bracket 432.

Figure 15:
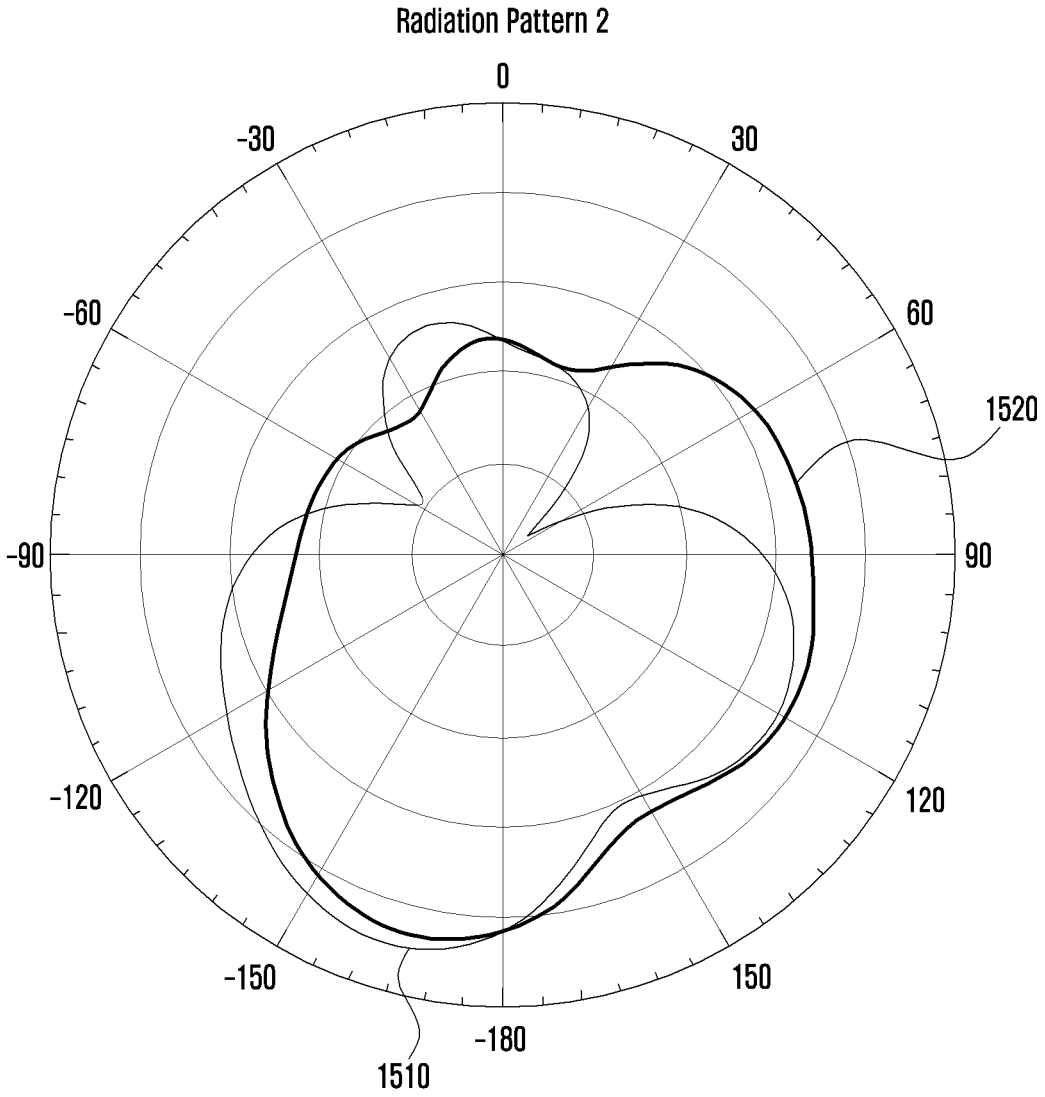
FIG. 15 is a graph illustrating a radiation pattern of an electronic device according to another embodiment.

FIG. 15 is a graph illustrating a radiation pattern of an electronic device (e.g., 101) according to another embodiment. According to an embodiment, FIG. 15 may be a graph showing a radiation pattern of an electronic device (e.g., 101) having the second antenna (e.g., 635) illustrated in FIG. 12 or 14.

Referring to FIG. 15, it can be seen that, in an electronic device (e.g., 101) according to an embodiment, the radiation pattern of antennas is not omnidirectionally distributed, but concentrated in a specific direction. For example, it can be seen the radiation pattern (1510) of the electronic device 101 according to an embodiment is concentrated not in a first direction of the electronic device 101, but in a second direction opposite to the first direction. According to various embodiments, since a second antenna (e.g., 635) is spirally formed, it is possible to concentrate the radiation pattern of the electronic device 101 in a specific direction without omnidirectionally distributing the radiation pattern (1520), so the performance of antennas can be further improved. For example, the electronic device 101 may be implemented as a portable device that can be attached to the handlebar of a bicycle or an indoor wall, and in this case, the antenna performance can be increased by concentrating the radiation pattern of antennas not omnidirectionally, but in a specific direction.

As described above, according to various embodiments, it is possible to improve antenna performance by reducing interference among a plurality of antennas in an electronic device including a plurality of antennal for IoT.

The electronic device according to various embodiments may be one of various types of electronic devices. The electronic devices may include, for example, and without limitation, a portable communication device (e.g., a smart phone), a computer device, a portable multimedia device, a portable medical device, a camera, a wearable device, and/or a home appliance, or the like. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it may refer to a situation in which the element may be coupled with the other element directly (e.g., via wire), wirelessly, or via a third element.

As used herein, the term "module" may include a unit implemented in hardware, software, or firmware, or any combinations thereof, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

While the present disclosure has been described with reference to various example embodiments thereof, it will be understood that the various example embodiments are intended to be illustrative, not limiting. One skilled in the art will understand that various modifications, variations and/or alternatives fall within the full spirit and full scope of the disclosure as defined, for example, in the appended claims, and their equivalents.

What is claimed is:

1. An electronic device comprising:

a housing including a first housing facing a first direction, and a second housing facing a second direction opposite the first direction;

a substrate disposed in the housing and having a first surface facing the first direction and a second surface facing the second direction opposite the first direction;

a first bracket disposed between the substrate and the first housing and including a first antenna and a second antenna; and a second bracket disposed between the substrate and the second housing and including a third antenna, wherein the substrate includes a communication circuit and a processor electrically connected with the communication circuit, wherein the first surface includes a first feed point connected with the communication circuit and a first connecting member comprising a conductor connecting the first feed point and the first antenna to each other, wherein the second surface includes a second feed point connected with the communication circuit and a second connecting member comprising a conductor connecting the second feed point and the third antenna to each other, and wherein the first surface further includes a conductive pad disposed to overlap the second feed point and a third connecting member comprising a conductor connecting the conductive pad and the second antenna to each other.

2. The electronic device of claim 1, wherein the first antenna is configured to transmit/receive frequency signals for WiFi, the second antenna is configured to receive frequency signals for a Global Navigation Satellite System (GNSS) and/or a Global Positioning System (GPS), and the third antenna is configured to transmit/receive frequency signals for cellular communication.

3. The electronic device of claim 2, wherein the cellular communication is at least one of: LTE, LTE-A (LTE Advance), Code Division Multiple Access (CDMA), Wideband CDMA (WCDMA), Universal Mobile Telecommunications System (UMTS), Wireless Broadband (WiBro), Global System for Mobile Communications (GSM), Cat-1, Cat-M1, and NB-IoT.

4. The electronic device of claim 2, wherein the communication circuit is electrically connected with the second antenna by capacitive coupling between the second feed point and the conductive pad.

5. The electronic device of claim 1, wherein the first feed point and the second feed point are positioned on opposite sides of the substrate when viewed from over the first surface or the second surface.

6. The electronic device of claim 1, wherein the first antenna is disposed on a side of the first bracket, and the second antenna is disposed on a top of the first bracket facing the first direction.

7. The electronic device of claim 6, wherein the second antenna is disposed on the top of the first bracket and spaced apart from the first antenna.

8. The electronic device of claim 7, wherein the second antenna has a semicircular shape.

9. The electronic device of claim 6, wherein the second antenna has a spiral shape.

10. The electronic device of claim 9, wherein the second antenna is spirally wound from an outer portion of the top of the first bracket; an end portion of the second antenna is disposed substantially at a center of the top of the first bracket; and the outer portion of the top of the first bracket is connected with the third connecting member.

11. The electronic device of claim 9, wherein the second antenna has a first part spirally wound from a side of the top of the first bracket and extending to substantially the center of the top of the first bracket and a second part extending from the first part to another outer portion of the top of the first bracket, wherein the first part is connected to the third connecting member.

12. The electronic device of claim 6, wherein the third antenna is disposed on a side of the second bracket, opposite the first antenna when viewed from over the first surface or the second surface.

* * * * *